US006290314B1

(12) United States Patent
Kim

(10) Patent No.: US 6,290,314 B1
(45) Date of Patent: Sep. 18, 2001

(54) REFRIGERATOR BARRIER STRUCTURE

(75) Inventor: Tae Young Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/448,872

(22) Filed: Nov. 24, 1999

(30) Foreign Application Priority Data

Nov. 25, 1998 (KR) ..... 98/23103

(51) Int. Cl.[7] ..... A47B 96/04
(52) U.S. Cl. ..... 312/407; 312/401; 312/296
(58) Field of Search ..... 312/236, 401, 312/405, 406, 407, 407.1, 400, 296; 49/475.1, 504; 62/441, 447, 465

(56) References Cited

U.S. PATENT DOCUMENTS 2,837,900 * 6/1958 Harle ..... 312/407 X
4,550,576 * 11/1985 Tate, Jr. et al. ..... 62/441
4,765,696 * 8/1988 Cordill et al. ..... 312/407
4,955,676 * 9/1990 Weaver et al. ..... 312/407
5,349,832 * 9/1994 Johnson et al. ..... 312/407 X
6,036,294 * 3/2000 Banicevic et al. ..... 312/296 X

* cited by examiner

*Primary Examiner*—Peter M. Cuomo
*Assistant Examiner*—James O. Hansen
(74) *Attorney, Agent, or Firm*—Fleshner & Kim, LLP

(57) ABSTRACT

Refrigerator barrier structure in a refrigerator body structure having a barrier for separating a refrigerating chamber and the freezing chamber, and a freezing chamber door and a refrigerating chamber door for open/closing of the freezing chamber and the refrigerating chamber respectively, including an area enlarging device on a front portion of the barrier for securing an area for close contact of gaskets on the freeze chamber door and the refrigerating chamber door, whereby enlarging effective spaces of the freeze chamber and the refrigerating chamber.

11 Claims, 3 Drawing Sheets

REFRIGERATOR BARRIER STRUCTURE

BACKGROUND OF THE INVENTION

1. Field of the Invention

The present invention relates to a refrigerator body structure, and more particularly, to a refrigerator barrier structure which can enlarge effective spaces of a freeze chamber and a refrigerating chamber.

2. Background of the Related Art

In general, the refrigerator is provided with a body which forms an outer appearance of the refrigerator, and components for conducting a refrigerating cycle, such as compressor, evaporator, condenser, expansion valve, and etc. The refrigerator body not only forms the outer appearance of the refrigerator, but also insulates the freeze chamber and the refrigerating chamber from outside.

A prior art refrigerator body structure will be explained with reference to FIGS. 1 and 2. The prior art refrigerator body is provided with an outer case 10 for forming an outer surface of the refrigerator, inner cases 20*a* and 20*b* for forming inner surfaces of the refrigerator, and a barrier 30 between the inner cases 20*a* and 20*b* for separating the freeze chamber 100 and the refrigerating chamber 200. There are doors 110 and 210 on a front surface of the refrigerating chamber 100 and the freeze chamber 200, there are gaskets 115 and 215 in inside surfaces of the doors 110 and 210 for sealing and insulating, and there is a metal plate 32 on a front surface of the barrier 30. An insulating material is stuffed in a space formed by the outer case 10 and the inner case 20*a* and 20*b* and an inside surface of the barrier 30. In detail, polyurethane foam is stuffed in the space formed by the outer case 10 and the inner cases 20*a* and 20*b*. However, the inside surface of the barrier is stuffed, not with polyurethane foam, but with Styrofoam 40 formed to a required size and shaped in advance, because the barrier 30 should have a cold air supply passage(not shown) for supplying a cold air heat exchanged in the evaporator mounted in a rear side of the freeze chamber 100 and a cold air feed back passage(not shown) for feeding back the air relatively heated in a heat exchange in the refrigerating chamber 200. If the styrofoam insulating material having none of the cold air supply passage and the cold air feed back passage formed therein in advance is not used, separate ducts for use as the cold air supply passage and the cold air feed back passage should be provided inside of the barrier 30, before an inside of the barrier 30 is stuffed with polyurethane.

However, the stuffing of styrofoam 40 of a size and form inside of the barrier 30 in the related art refrigerator barrier structure has the following problems.

First, the styrofoam has a poor insulating property compared to polyurethane. Therefore, the styrofoam insulating material 40 should be thick for securing an adequate insulating performance, that results in a thick barrier 30. That is, the thicker barrier 30 results in a reduced freeze chamber 100 and a refrigerating chamber 200, that drops a spatial efficiency of the refrigerator.

Second, because the styrofoam insulating material 40 is more expensive than the polyurethane the use of styrofoam pushes up a production cost of the refrigerator. Accordingly, in order to solve the problem, a method is suggested, in which a polyurethane insulating film is formed in the barrier 30. In this instance, separate cold air feed back duct and the like are provided in advance before polyurethane is stuffed between the outer case 10 and the inner cases 20*a* and 20*b*.

However, such a method has the following problems.

Even the stuffing of the barrier space with polyurethane can not reduce a thickness of the barrier below a limit, because a space for close contact of gaskets for the refrigerating chamber and the freeze chamber should be secure on a front surface of the barrier. That is, in the related art method, even if polyurethane which has a good insulating property is used, enlarging effective spaces of the refrigerating chamber and the freeze chamber has been difficult since a thickness of the barrier should be kept greater than a certain limit for close contact of the gaskets. Moreover, the cold air ducts are deformed by a foam pressure during foaming.

SUMMARY OF THE INVENTION

Accordingly, the present invention is directed to a refrigerator barrier structure that substantially obviates one or more of the problems due to limitations and disadvantages of the related art.

An object of the present invention is to provide a refrigerator barrier structure which has an adequate insulating performance while a refrigerator space can be maximized.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the refrigerator barrier structure in a refrigerator body structure having a barrier for separating a refrigerating chamber and a freezing chamber, and a freezing chamber door and a refrigerating chamber door for open/closing of the freezing chamber, and the refrigerating chamber respectively, includes area enlarging means on a front portion of the barrier for securing an area for close contact of gaskets on the freeze chamber door and the refrigerating chamber door.

The area enlarging means including a horizontal portion in close contact with the barrier, and a vertical portion in close contact with a front portion of the barrier.

The area enlarging means further includes a front plate fitted to the horizontal portion of the area enlarging means.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
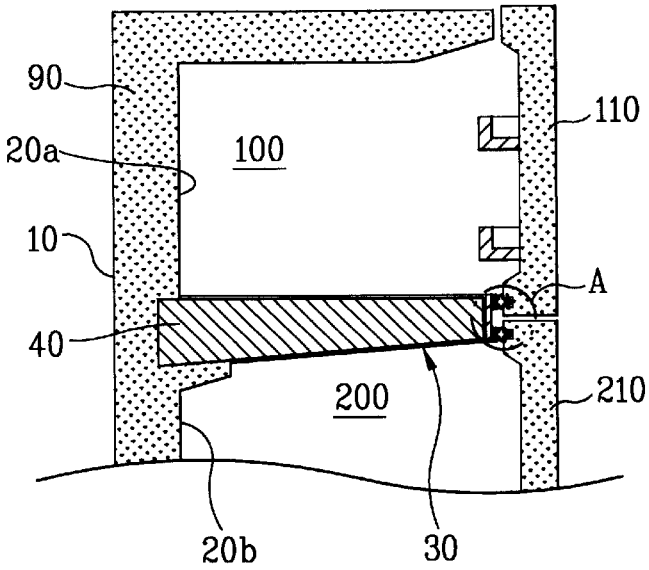
FIG.1 Prior Art
FIG. 1 illustrates a section of a prior art refrigerator body structure.
Figure 2:
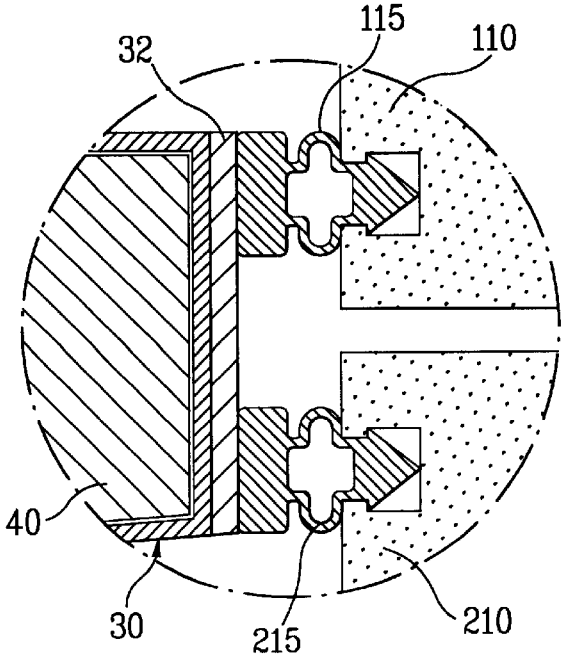
FIG.2 Prior Art
FIG. 2 illustrates a partial enlarged sectional view of "A" part in FIG. 1.
Figure 3:
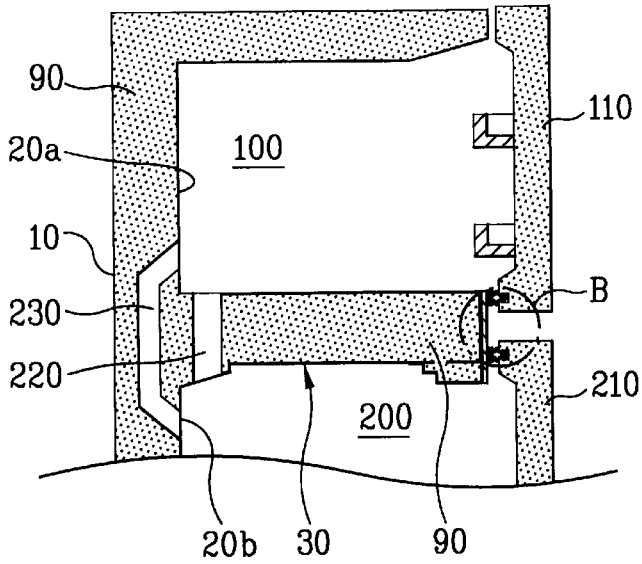
FIG. 3 illustrates a section showing a refrigerator barrier structure in accordance with a preferred embodiment of the present invention.
Figure 4:
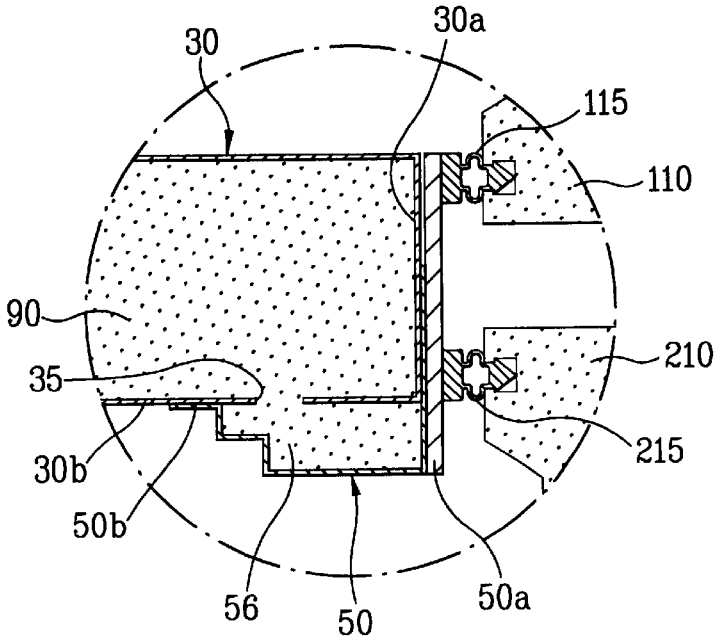
FIG. 4 illustrates a partial enlarged sectional view of "B" part in FIG. 3; and, FIG. 5 illustrates a perspective disassembled view of FIG. 3.
Figure 5:
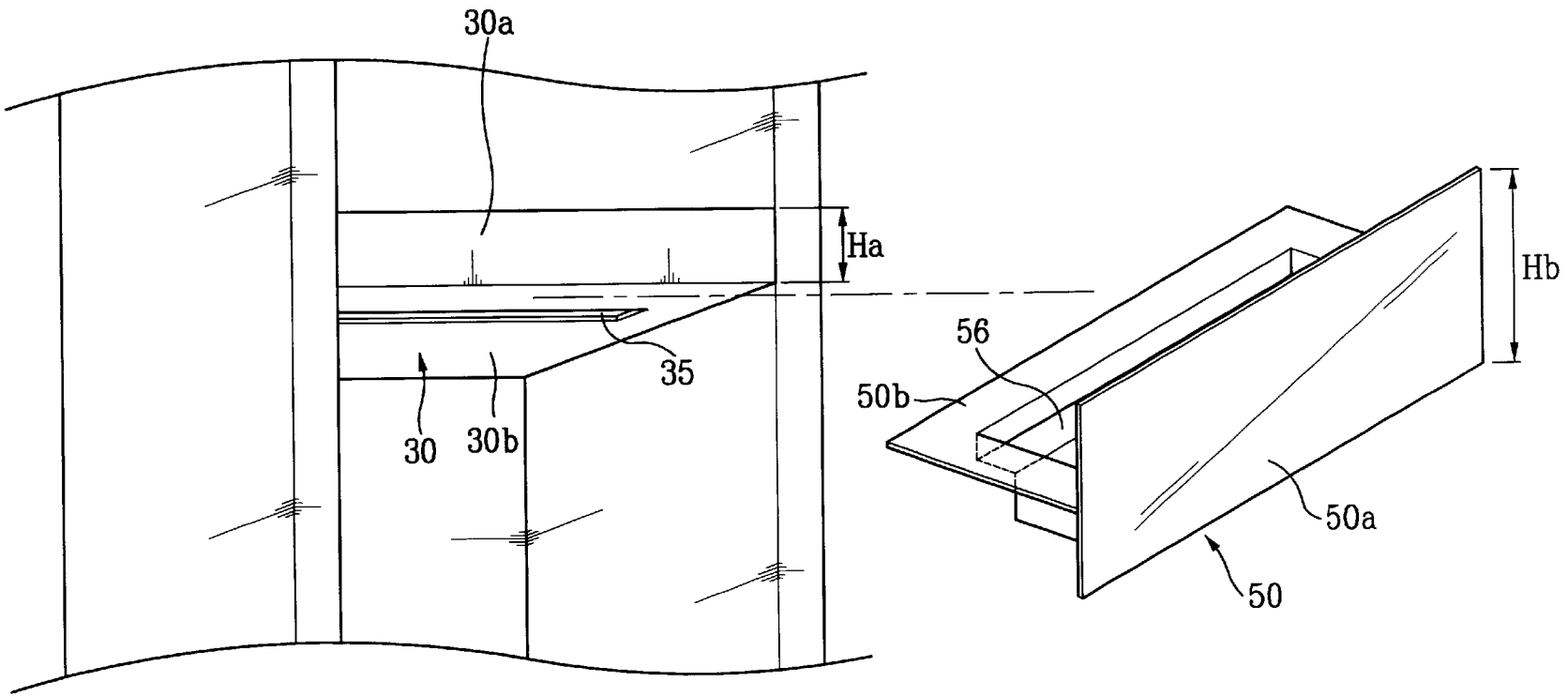

Reference will now be made in detail to the preferred embodiments of the present invention, examples of which are illustrated in the accompanying drawings. FIG. 3 illustrates a section showing a refrigerator barrier structures in accordance with a preferred embodiment of the present invention, FIG. 4 illustrates a partial enlarged sectional view of "B" part in FIG. 3, and FIG. 5 illustrates a perspective disassembled view of FIG. 3. Components of the present invention identical to the prior art will be given identical reference symbols, and explanations on the identical components will be omitted. The present invention suggests to provide an area enlarging means 50 on a front surface of the barrier 30 to enlarge the front surface of the barrier 30 without providing a thick barrier 30 for permitting close contact of gaskets of the refrigerating chamber door and the freezing chamber door.

The area enlarging means 50 will be explained with reference to FIGS. 4 and 5.

The area enlarging means 50 includes a horizontal portion 50*b* attached to a bottom portion 30*b* of the barrier 30 and a vertical portion 50*a* attached to a front portion 30*a* of the barrier 30. Of course, a height Hb of the vertical portion 50*a* is thicker than a thickness Ha of the front portion 30*a* of the barrier 30, and has a size required to bring the gaskets into close contact. The horizontal portion 50*b* of the area enlarging means is recessed, to provide a space 56 for stuffing an insulating material, for example, polyurethane, preferably with a feeding hole 35 in a bottom portion 30*b* of the barrier 30 opposite to the space 56. Because an insulating performance can be improved further owing to an insulating layer formed as polyurethane liquid flows into inside of the area enlarging means 50 through a flow hole 35 in the barrier 30 if the polyurethane liquid is injected under a state the area enlarging means 50 is fastened to the barrier 30. Of course, insulating material may be stuffed in the area enlarging means 50 before the area enlarging means are attached to the front surface of the barrier 30. Though, this embodiment of the present invention explains that polyurethane is injected into the barrier 30 and the area enlarging means 50 for forming an insulating layer therein, the present invention is not limited to this. For example, the insulating layer may be formed of other insulating material which has a better insulating property. And, though this embodiment of the present invention shows and explains that the area enlarging means 50 is extended to a region under the barrier 30, the present invention is not limited to this. That is, the area enlarging means 50 may be extended upward toward the freeze chamber 100, or in both directions. And, of course, it is possible that the area enlarging means 50 may be formed, not separate from the barrier 30, but as a unit with the barrier 30. It is preferable that a separate front plate 50*a* is provided on a front surface of the area enlarging means 50 to bring the doors 110 and 210 into close contact with the front plate 50*a* by means of magnets in the gaskets 115 and 215. A length of the vertical position 50*a* of the area enlarging means 50 may be shortened when the front plate is applied. Of coarse, the front plate 50*a* may not be applied or formed as a unit with the area enlarging means 50. The fitting of the area enlarging means 50 to the front surface if the barrier 30 can be done by using a general fitting methods, such as fitting using adhesives or screws, of which further explanations will be omitted. As explained, if the area enlarging means 50 is applied to the front surface of the barrier 30, the barrier 30 may be formed thinner by using polyurethane which has an excellent insulating property instead of the styrofoam in the related art or a material which has an insulating property better than this. Because the front portion of the barrier can be provided with an adequate area for the close contact of the gaskets on the doors by the area enlarging means 50.

In the meantime, in a case when the area enlarging means 50 is applied to the front portion of the barrier 30 and the insulating 90 is formed by injecting and foaming polyurethane in the barrier 30, it is preferable that the ducts provided in the barrier 30 are minimized, because deformation of the ducts by a foaming pressure can be minimized and spaces for stuffing the polyurethane inside the barrier 30 can be increased, than can improve an insulating performance. In detail, as shown in FIG. 3, it is preferable that the cold air feed back duct 230 is formed, not passed through the barrier 30, but within a rear wall of the body, and the cold air supply duct 220 is formed in a straight line form in a rear portion of the barrier 30 as far as possible.

The refrigerator barrier structure of the present invention has the following advantages.

First, the application of the area enlarging means permits to reduce a thickness of the barrier by using an insulating material which has an excellent insulating property. Because, through the thickness of the barrier can not be reduced below a certain limit for securing an area for contacting with the gaskets even if an excellent insulating material is used in the related art, the use of the area enlarging means solves this problem. The thinner barrier made available by the present invention provides a larger refrigerating chamber and freezing chamber for putting more food therein. That is, the enlarged spaces of the refrigerating chamber and the freezing chamber for the same external size improves a spatial efficiency.

Second, as an inside of the barrier can be stuffed with an insulating material with an excellent insulating performance and a relatively low cost, such as polyurethane, instead of the expensive styrofoam insulating material of the related art, a production cost can be reduced.

It will be apparent to those skilled in the art that various modifications and variations can be made in the refrigerator barrier structure of the present invention without departing from the spirit or scope of the invention. Thus, it is intended that the present invention cover the modifications and variations of this invention provided they come within the scope of the appended claims and their equivalents.

What is claimed is:

1. A refrigerator, comprising:

a refrigerator body including a refrigerator compartment and a freezer compartment;

a freezer door having a sealing gasket, wherein the freezer door is mounted on the refrigerator body such that when the freezer door is closed, the sealing gasket seals the freezer compartment;

a refrigerator door having a sealing gasket, wherein the refrigerator door is mounted on the refrigerator body such that when the refrigerator door is closed, the sealing gasket seals the refrigerator compartments;

a barrier that separates the freezer compartment from the refrigerator compartment; and an area enlarging assembly mounted on a front face of the barrier, wherein the area enlarging assembly includes a vertical face plate having a height that is substantially greater that a vertical height of a front face of the barrier and the area enlarging assembly also includes an insulating portion that extends horizontally away from the vertical face plate, wherein the area enlarging assembly is configured so that the insulating portion abuts a horizontal surface of the barrier, and wherein the vertical face plate is configured to contact the sealing gaskets of the refrigerator and the freezer door when the refrigerator and freezer doors are closed to help seal the refrigerator and freezer compartments.

2. The refrigerator of claim 1, wherein a first aperture is formed in the horizontal surface of the barrier, wherein a second aperture is formed on a abuting horizontal surface of the insulating portion, and wherein the area enlarging assembly is configured so that the first and second apertures are at least partially coincident.

3. The refrigerator of claim 2, wherein the first and second apertures are aligned such that the material within the barrier can flow through the first and second apertures and into the insulating portion of the area enlarging assembly.

4. The refrigerator of claim 1, wherein the insulating portion contains a thermal insulating material.

5. The refrigerator of claim 1, wherein a portion of the vertical face plate of the area enlarging assembly extends from one of an upper and lower edge of the barrier towards one of the freezer compartment and the refrigerator compartment, to thereby increase an area of the face plate contacted by the sealing gaskets to seal the refrigerator and freezer compartments.

6. A refrigerator, comprising:

a refrigerator body including a refrigerator compartment and a freezer compartment;

a freezer door having a sealing gasket, wherein the freezer door is mounted on the refrigerator body such that when the freezer door is closed, the sealing gasket seals the freezer compartments;

a refrigerator door having a sealing gasket, wherein the refrigerator door is mounted on the refrigerator body such that when the refrigerator door is closed, the sealing gasket seals the refrigerator compartment;

a barrier that separates the freezer compartment from the refrigerator compartment; and area enlarging means, mounted on a front end of the barrier, for enlarging an area contacted by the sealing gaskets of the refrigerator and freezer doors relative to an area of a front face of the barrier, wherein the barrier includes a first aperture, wherein the area enlarging means includes a second aperture, and wherein the first and second apertures are at least partially coincident such that material in the barrier can flow through the first and second apertures and into the area enlarging means.

7. The refrigerator of claim 6, wherein the area enlarging means has a vertical height that is substantially greater than a vertical height of the front face of the barrier.

8. The refrigerator of claim 6, wherein the area enlarging means is configured to contact adjacent portions of the sealing gaskets of the refrigerator door and the freezer door when the refrigerator and freezer doors are closed to help seal the refrigerator and freezer compartments.

9. The refrigerator of claim 6, wherein the area enlarging means also includes an insulating portion configured to contain an insulating material.

10. The refrigerator of claim 9, wherein the area enlarging means is configured so that the insulating portion abuts a horizontal surface of the barrier.

11. The refrigerator of claim 6, wherein the area enlarging means extends an area configured to contact the sealing gaskets of the refrigerator and freezer doors at least one of above and below the front face of the barrier.

* * * * *